US006133831A

United States Patent [19]

Kyles

[11] Patent Number: 6,133,831

[45] Date of Patent: Oct. 17, 2000

[54] PURSE ARM ALARM SYSTEM

[76] Inventor: Jody Lynn Kyles, P.O. Box 8311, Tacoma, Wash. 98418

[21] Appl. No.: 09/216,873

[22] Filed: Dec. 21, 1998

[51] Int. Cl.[7] ..... G08B 13/14

[52] U.S. Cl. ..... 340/571; 340/568.1; 340/568.4; 340/568.7

[58] Field of Search ..... 340/571, 568.1, 340/568.4, 568.7, 568.8

[56] References Cited

U.S. PATENT DOCUMENTS 5,164,706 11/1992 Chen ..... 340/571

5,408,220 4/1995 Brown et al. ..... 340/571

5,920,260 7/1999 Tseng ..... 340/571

*Primary Examiner*—Benjamin C. Lee

*Attorney, Agent, or Firm*—John P. Halvonik

[57] ABSTRACT

The invention is a secured purse that emits a security alarm sound when the purse is grabbed by a robber or attacker. The purse includes purse straps that are detachable from the purse by a system of pull pins that allow the strap to detach from the purse in the event that the purse is snatched. At the same time the pins are connected to an electronic system that sends an electronic signal to an audible alarm that emits a loud sound when the straps have been detached.

1 Claim, 1 Drawing Sheet

PURSE ARM ALARM SYSTEM

FIELD OF THE INVENTION

The invention relates to the field of alarms and, in particular, to a purse equipped with an audible alarm that will sound when the purse is snatched. Such apparatus includes break away straps that allow the bag to be detached from the purse when it is grabbed and, at the same time, to emit an audible alarm once the connection between the strap and the bag has been broken.

BACKGROUND AND PRIOR ART

While there are purses that are equipped with audible alarms there are none in the prior art that emit an alarm in response to breaking the connection between the straps and the purse bag itself. In this case, the purse straps are designed to be detachable and this design feature is also thought to be novel for use in connection with purses.

It is thought that the present invention will be useful to both men and women as both sexes have the need to carry devices with straps on their person that hold valuables. Women nowadays are more likely to carry a purse than a man however, such fact does not preclude men from using this apparatus as well as women.

With that in mind designing a purse with detachable straps will be an altogether safer mechanism for protecting the user of the purse in the event of a mugging, robbery, etc. Many such robbery attempts cause more harm to the victim than need be because the victim is trying to keep his or her purse. Physically interfering with a robber will probably result in more injury to the victim given a large number of data points. In this case, the detachable straps allow the attacker to remove the purse from the person of the victim without any undue force, this of course means that the victim has lost his or her purse for the time being but the robber did not have to pull or otherwise use undue pressure to remove the purse.

It is believed that the invention described herein will find its greatest utility in use with women who carry purses nearly every day and for nearly every occasion. It is well known that purses are an everyday item and are used to carry valuables and thus present an obvious target for those who carry them since it is well known that valuables are likely to be inside.

SUMMARY OF THE INVENTION

The invention is a secured purse that emits a security alarm sound when the purse is grabbed by a robber or attacker. The purse includes purse straps that are detachable from the purse by a system of pull pins that allow the strap to detach from the purse in the even that the purse is snatched. At the same time the pins are connected to an electronic system that sends an electronic signal to an audible alarm that emits a loud sound when the straps have been detached.

It is among the objectives to provide a security device for purses that will sound an audible alarm in the event that the purse is stolen, snatched or otherwise removed from the person that is carrying it.

It is among the objectives to provide a security device for a purse that will avoid exposing its user to any unnecessary injury in the event of a purse snatching.

Another objective is to provide a purse having an audible signal for emitting a loud signal in the event such purse is the target of a purse snatching or robbery.

Another objective is to provide a purse that emits an audible signal in the event of purse snatching and such audible signal will remain on and continue to be emitted from the purse as long as the attacker holds onto the purse.

Another objective is to provide a purse with an electronic alarm for emitting an audible signal in the event that the purse straps of the purse are detached from the purse bag.

Other objectives will be apparent once the invention is shown and described.

DESCRIPTION OF THE PREFERRED EMBODIMENT

Figure 1:
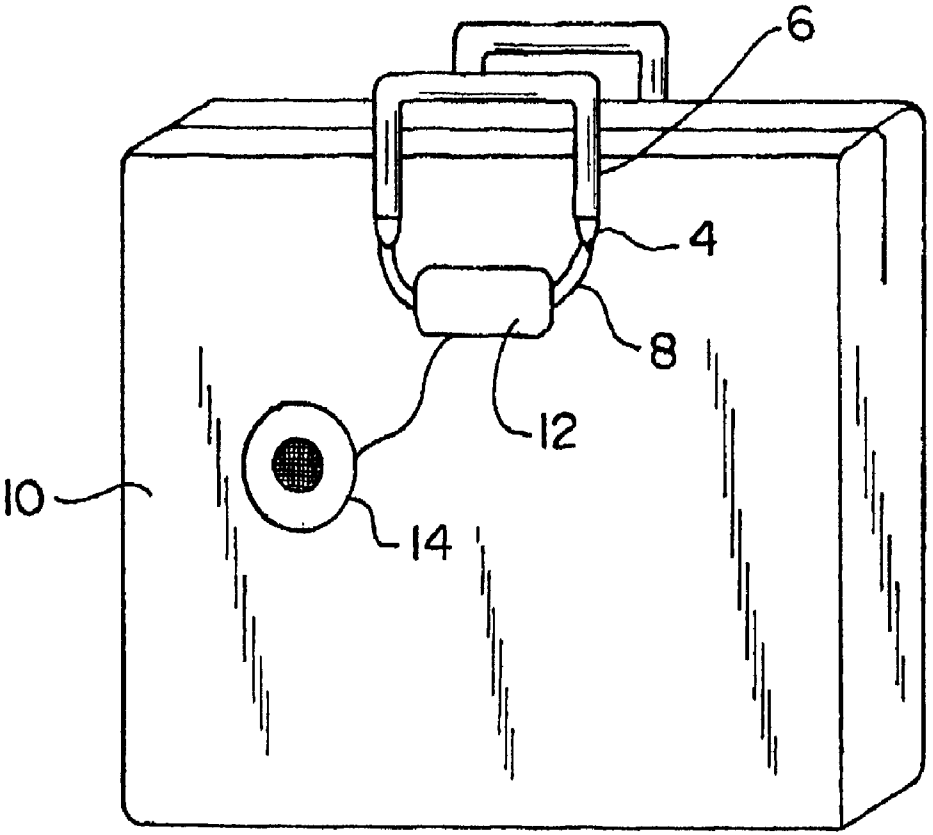
FIG. 1 overall construction of the purse.

The overall construction of the apparatus is shown in FIG. 1, There are purse straps 6 in connection with the purse bag 10 itself that holds the contents of the purse. The straps may be of any style. Note here, the purse illustrated is rather generic in style; other shapes and varieties of purse designs may be used without violating the spirit of the invention. By the same token, shoulder straps (straps that are sized to go around the shoulder) or handbag style (straps that are shorter and allow the purse to be carried by hand) are two of the more likely strap lengths that are contemplated by this invention.

The straps are physically connected to the bag by means of pull pins 4 held within receptacles (8 in FIG. 2) affixed to the bag in some manner. Such pin/receptacle connection may be thought of as any mechanical type of connection that joins the strap to the bag and can be pulled apart. In this case, the pull pins should not be very secure but rather they should allow the straps to break off the bag when the bag is tugged on with some force. The exact strength of this connection can be determined by trial and error but it is thought that strength of the pin/connection should be strong enough to hold the weight of a typical purse; perhaps 1–2 lbs. Since the force of someone trying to rip the purse off of the person's arm is probably several times that it should be no problem to make a connection that will secure loads at 1 or 2 lbs. and disengage when forces of 20 or more lbs of force are exerted upon it.

The pins would necessarily need to be conductors of electric current so that they can send a signal to the alarm system when the purse is snatched. Wires 8 complete the connection to the alarm system 12. The electronic circuit should include the contact points and in the event that the connection is broken, the pins will be broken away from the electronic contacts so that an electronic circuit will be completed and hence, a signal will be send to the alarm system when the purse is snatched. Once the signal is sent to the alarm system, an audible signal will be produced by that system and the alarm has now been activated. The alarm system would come with a speaker 14 in order to broadcast the audible alarm signal.

Figure 2:
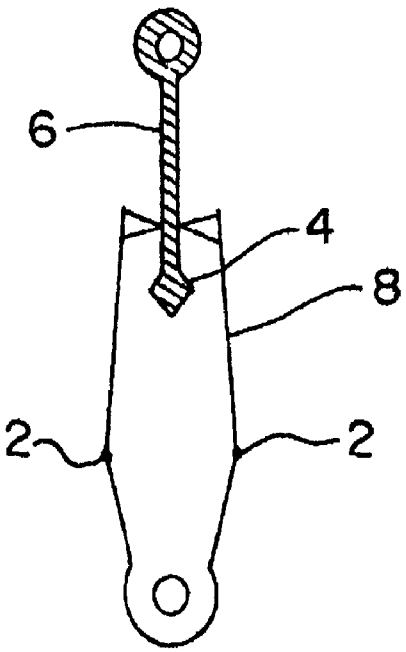
FIG. 2 detail of one type of activation system to be used.

The term "pull pin" is used for any sort of frangible connection that can be broken by pulling out it with sufficient pressure. There are many various types of connections that are suitable for the invention described herein. One such example is shown in FIG. 2 where the electrical contact points 2 are held apart by the plug shaped ends 4 of the straps 6. When the plug is pulled out of the connection, the contact points will come together thus completing the electric circuit and sending signal to the audible alarm portion 12 of the system. There may be, for example, springs 8 that will urge the contact points together once the connection is removed.

Springs would of course, by in use at all times but only come into play once the connection has been broken. In FIG. 2 these are shown as leaf springs that tend to come together but compression springs, etc. could be used as well.

The plug and receptacle (may be thought of as 8 in FIG. 2) can also be equipped with VELCRO (TM name for hook and loop material) type connections or it can be a pin held within a conduit that is broken when it is removed. Other methods of structurally holding the pin in the receptacle portion can be used without violating the spirit of the invention. In any case, it is important, that circuit be set up so that an electronic signal will be sent to the alarm portion 12 of the system when the pull pin has been removed from the receptacle.

The chip used for the electrical system may be run on small batteries. Any other electrical systems used would also have to be run on batteries or at least some form of power that enables the circuit to be powered for long periods of time without having to be recharged. Of course, the speaker and any other electronic components may be powered by this battery.

The alarm system probably should not come with a turn off switch or at least the turn off mechanism should not be one that can easily be seen and/or operated. This is because it is deemed more important that the mugger or robber not be able to deactivate the audible alarm while he is trying to carry away the purse. The turn off mechanism should be somewhat involved and not something that can easily be turned off under the pressure of a purse snatching. For example, the turn off system may require the user to input a numerical or alphabetical code in order to turn off the alarm or the user may need to go through a set of command signals in order to deactivate the alarm. In this manner, the user can eventually turn off the purse alarm, after the purse has been recovered but it will not allow the mugger or attacker to turn the purse alarm off while he has the purse in his possession.

It is thought that the preferred embodiment would include an electronic circuit that may based upon an electronic chip design. Such chips are well known and can be miniaturized to include circuitry within a very small amount of area. The pull pins should be reattachable in order to disconnect the circuit and stop the alarm. This may be useful in the event that it is desired to test the alarm, in which case the straps can be pulled from the bag, the alarm will sound and then the pins can be reattached to the purse in order to deactivate the alarm. In this case, the attachment of the pins should send a signal to the alarm system in order to deactivate the audible alarm.

The purse may be made of various materials that are well known in the art. These include wicker, straw, leather and cloth designs. Obviously hand bags and shoulder bags can come in a variety of models and these are included in the inventive concept herein. Shoulder straps and such may be of varying lengths, and hence the size and length of the strap may be varied without violating the spirit of the invention. The purse of course, can come in many shapes and sizes.

The principle of using frangible connection of pull pins/receptacle that sends an electronic signal to an alarm can be applied to many other devices that use straps including: fanny packs, handbags, backpacks, beach bags and other devices with straps that are used to carry valuables.

The alarm system herein can also double as a warning system that the user can activate herself. This would be by simply pulling the strap off the purse even in circumstances where the purse has not been snatched.

What is claimed is:

1. A purse with an alarm function having purse straps and a main body, said purse straps having opposite ends for connection with said main body of said purse, each of at least one set of said opposite ends having a nonconductive male plug, said main body having an alarm system for emitting an audible warning and respective female sockets adapted for fitting with male plugs, said female sockets each having electrical contacts on opposite sides thereof and having a biasing means in connection with each of said electrical contacts so as to form an electrical connection between said contacts when a corresponding male plug is not in the female socket, said alarm system having electrical connections to each of said electrical contacts so as to form a circuit that will send an electric alarm signal to said alarm system when said electrical connection is formed; said alarm system having a meas to activate an audible warning in the event said electrical alarm signal is received by said alarm system.

* * * * *